US008162694B2

(12) United States Patent
Hisada et al.

(10) Patent No.: US 8,162,694 B2
(45) Date of Patent: Apr. 24, 2012

(54) CONNECTOR

(75) Inventors: Shoichi Hisada, Hachioji (JP); Takashi Kawasaki, Tama (JP); Takao Inoue, Sagamihara (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 108 days.

(21) Appl. No.: 12/830,569

(22) Filed: Jul. 6, 2010

(65) Prior Publication Data

US 2011/0009002 A1 Jan. 13, 2011

(30) Foreign Application Priority Data

Jul. 7, 2009 (JP) ..... 2009-160319

(51) Int. Cl.
*H01R 13/648* (2006.01)

(52) U.S. Cl. ..... 439/607.23; 439/358

(58) Field of Classification Search ..... 439/79, 439/358, 607.01, 607.11, 607.12, 607.23, 439/607.24, 607.25, 607.52–607.57, 660
See application file for complete search history.

(56) References Cited

U.S. PATENT DOCUMENTS

| | | | | |
|---|---|---|---|---|
| 6,315,608 | B1 * | 11/2001 | Lopata et al. | 439/607.36 |
| 7,128,595 | B2 * | 10/2006 | Boutros | 439/358 |
| 7,850,477 | B2 * | 12/2010 | Koyama et al. | 439/358 |
| 7,862,368 | B1 * | 1/2011 | Lai et al. | 439/358 |
| 7,946,887 | B1 * | 5/2011 | Zhang et al. | 439/607.23 |
| 8,011,959 | B1 * | 9/2011 | Tsai et al. | 439/607.25 |
| 8,011,960 | B2 * | 9/2011 | Xiao et al. | 439/607.56 |

FOREIGN PATENT DOCUMENTS

JP 3425688 B2 5/2003

* cited by examiner

*Primary Examiner* — Thanh Tam Le
(74) *Attorney, Agent, or Firm* — Holtz, Holtz, Goodman & Chick, PC

(57) ABSTRACT

A connector includes a shell provided as a cylindrical shape having an opened front side; a first insulator arranged in the shell; a second insulator arranged in the shell to be parallel to the first insulator; a first contact provided to be arranged in the first insulator; a second contact provided to be arranged in the second insulator; and a partition section arranged in the shell in a state of projecting from an outside of the shell to an inside of the shell so as to partition a hollow in the shell to a first region in which the first insulator exists and a second region in which the second insulator exists as viewed from the front side of the shell, the partition section being provided to be movable to the outside of the shell.

11 Claims, 15 Drawing Sheets

CONNECTOR

BACKGROUND OF THE INVENTION

1. Field of the Invention

The present invention relates to a connector, and more particularly to a connector capable of allowing different type opposite connectors to be fit thereto.

2. Description of the Related Art

For example, as described in Japanese Patent Publication No. 3425688, a receptacle connector (11) generally includes a conductive shell (14), an insulator (13) housed in the shell (14), and a plurality of conductive contacts (12) mounted on the insulator (13). A plug connector (1) to be fit into the receptacle connector (11) includes a cylindrical insulator (3) and a plurality of conductive contacts (2) provided on the inside of the cylindrical insulator (3). If the insulator (3) of the plug connector (1) is inserted into the shell (14) of the receptacle connector (11) in order to fit the plug connector (1) to the receptacle connector (11), the insulator (13) of the receptacle connector (11) is inserted into the insulator (3) of the plug connector (1), and the mutual contacts (2 and 12) of these connectors (1 and 11) are contacted with each other.

Incidentally, it has been practiced to house two insulators in parallel in a shell in a receptacle connector. A plurality of contacts is provided to the respective insulators. As a plug connector to be fit into such a receptacle connector, there are a plug connector into which one insulator of a receptacle connector is inserted (hereinafter referred to as a first plug connector) and a plug connector into which two insulators of a receptacle connector are inserted (hereinafter referred to as a second plug connector).

Two insertion openings are formed in the insulator of a second plug connector. When the insulator of the second plug connector is fit into the shell of a receptacle connector, the two insulators of the receptacle connector are inserted into the two insertion openings, respectively. On the other hand, one insertion opening is formed in the insulator of a first plug connector. When the insulator of the first plug connector is inserted into the shell of a receptacle connector, the insulator of the receptacle connector is inserted into the insertion opening.

The external shape of the insulator of a second plug connector is almost the same shape as that of the shell of the receptacle connector, and the insulator of the second plug connector is fit into the shell of the receptacle connector without any gaps. Consequently, the insulator of the second plug connector is configured to be difficult to be pulled out from the shell of the receptacle connector. On the other hand, because there are two insulators in the shell of the receptacle connector, the external form of the insulator of a first plug connector is smaller than that of the shell of the receptacle connector, and a large hollow is led to be produced in the shell of the receptacle connector even if the insulator of the first plug connector is inserted into the shell of the receptacle connector. Consequently, it is apprehended that the insulator of the first plug connector may be pulled out from the shell of the receptacle connector if a load urging the insulator of the first plug connector to the hollow side is exerted on the insulator of the first plug connector.

SUMMARY OF THE INVENTION

Accordingly, it is an object of the present invention to provide a receptacle connector capable of preventing the pulling-out of a plug connector smaller than the shell of the receptacle connector when the plug connector is inserted into the shell.

According to an aspect of the present invention, there is provided a connector, comprising:

a shell provided as a cylindrical shape having an opened front side;

a first insulator arranged in the shell;

a second insulator arranged in the shell to be parallel to the first insulator;

a first contact provided to be arranged in the first insulator;

a second contact provided to be arranged in the second insulator; and a partition section arranged in the shell in a state of projecting from an outside of the shell to an inside of the shell so as to partition a hollow in the shell to a first region in which the first insulator exists and a second region in which the second insulator exists as viewed from the front side of the shell, the partition section being provided to be movable to the outside of the shell.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

In the following, embodiments of the present invention will be described in detail with reference to the accompanying drawings.

Technically preferable various limitations for implementing the present invention are, however, put onto the embodiments to be described in the following, but the scope of the invention is not limited to the embodiments and shown examples in the following.

First Embodiment

Figure 1:
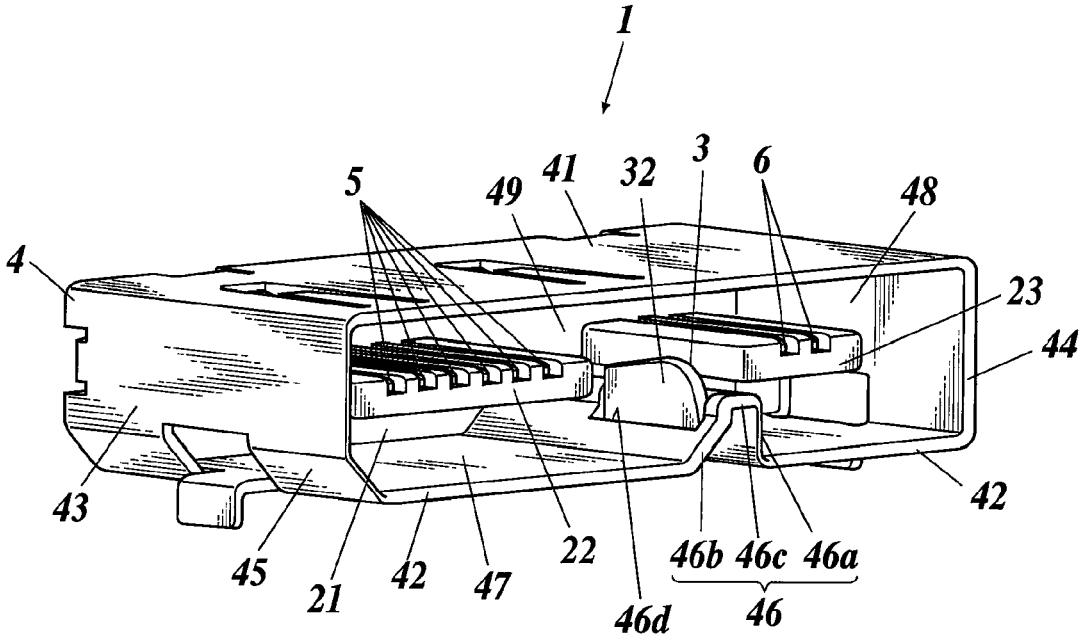
FIG. 1 is a perspective view showing the connector of a first embodiment of the present invention.
Figure 2:
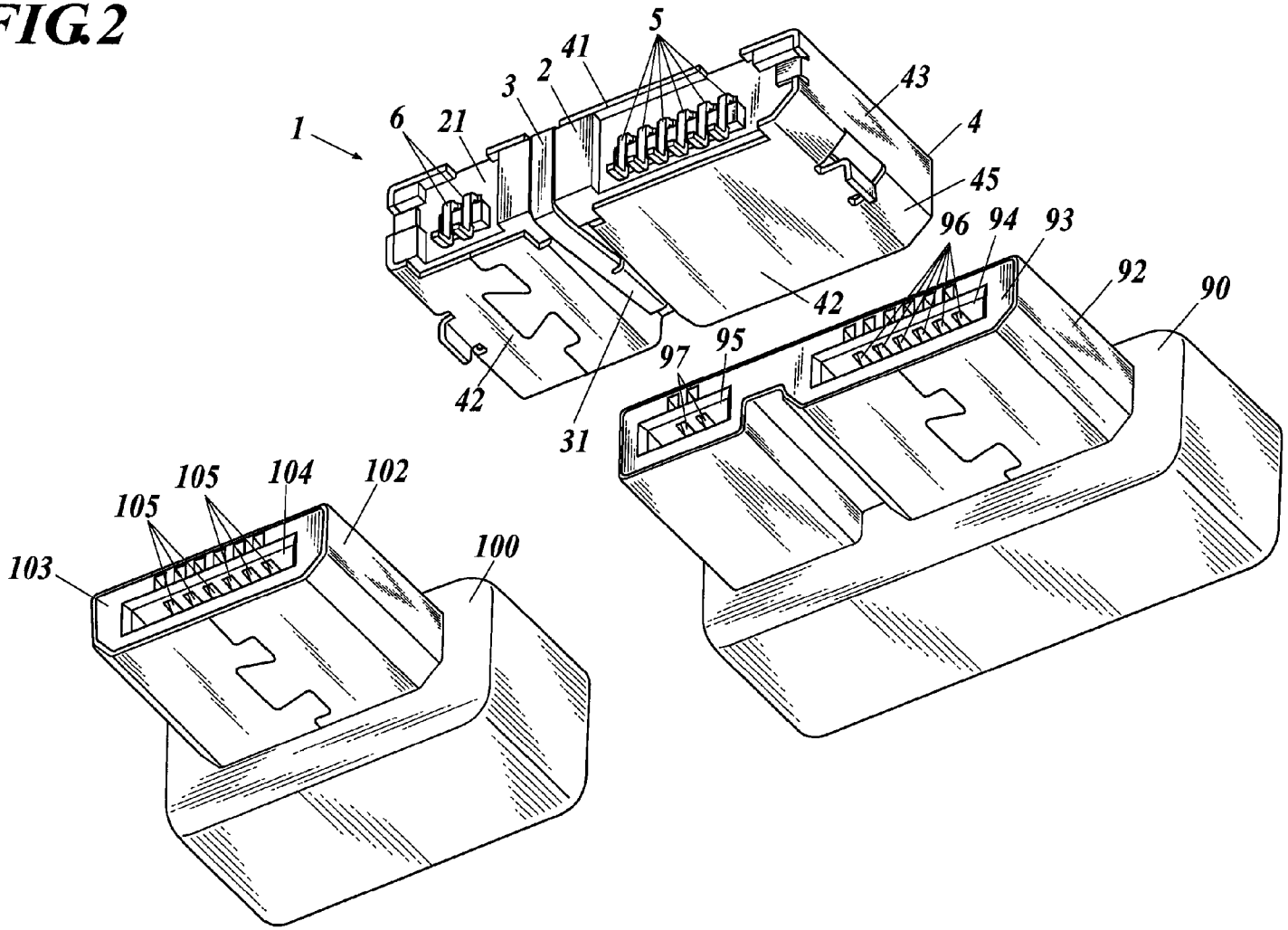
FIG. 2 is a perspective view showing the connector of the embodiment and two plug connectors.
Figure 3:
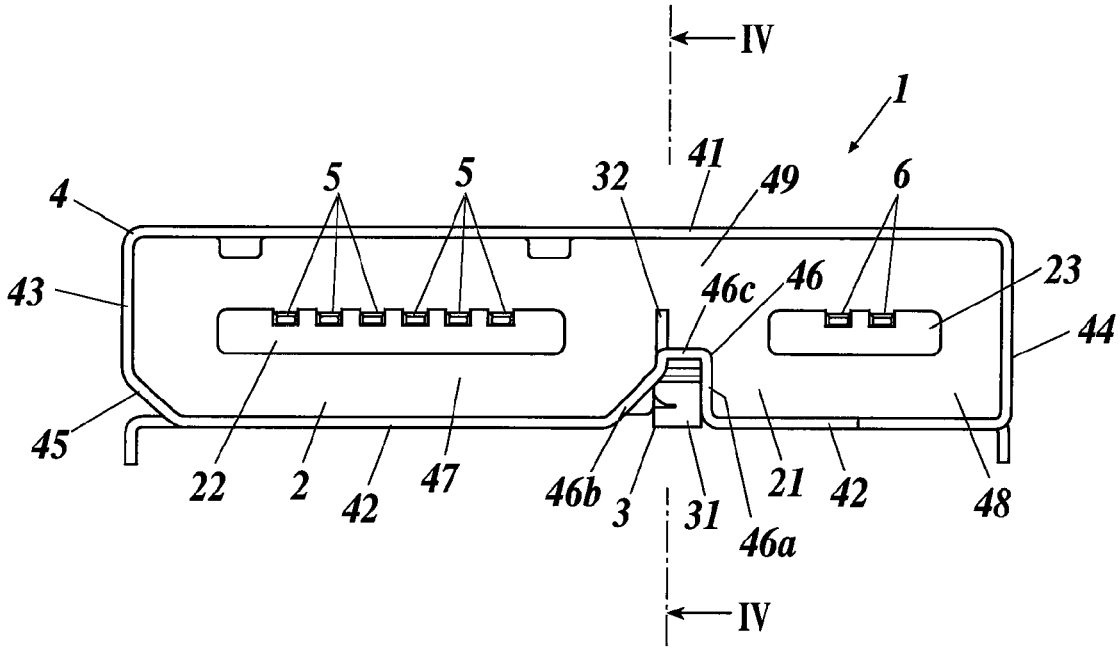
FIG. 3 is a front view showing the connector of the embodiment.
Figure 4:
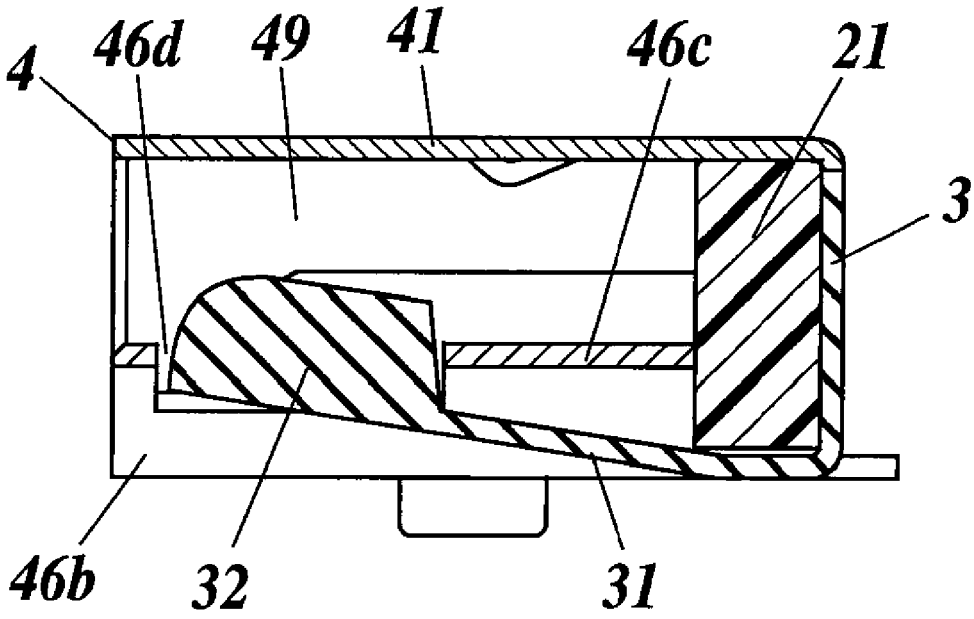
FIG. 4 is a sectional view showing the connector of the embodiment.

FIG. 1 is a perspective view showing a receptacle type connector 1. FIG. 2 is a perspective view showing the connector 1 and plug type plug connectors 90 and 100. FIG. 3 is a front view of the connector 1. FIG. 4 is a sectional view of the surface along the cutting plane line IV-IV shown in FIG. 3 when the surface is observed from the direction denoted by arrows.

As shown in FIGS. 1-4, the receptacle type connector 1 includes a molded resin member 2, an elastic piece 3, a shell 4, a plurality of contacts 5 and 6, and the like.

The shell 4 is formed in a cylindrical shape and is made of a conductive metal. The front side of the shell 4 is opened to be configured to be capable of being fit to the opposite connectors 90 and 100.

The shell 4 includes an upper wall 41, a lower wall 42, a left wall 43, and a right wall 44. The upper wall 41 and the lower wall 42 are opposed to each other, and the left wall 43 and the right wall 44 are provided on the left and the right sides of the upper wall 41, respectively. The right wall 44 is provided on the right side of the lower wall 42. An inclined wall 45 is formed at the internal angle section between the lower wall 42 and the left wall 43. The inclined wall 45 inclines to fall rightward.

A projecting section 46, projecting toward the upper wall 41, is formed between the left end and the right end of the lower wall 42. The space in the shell 4 is separated by the projecting section 46 into a region 47 on the side of the left wall 43 to the projecting section 46 and a region 48 on the side of the right wall 44 to the projecting section 46. The projecting section 46 includes a standing wall section 46*a* on the right side thereof, an inclined section 46*b* on the left side, and a vertex section 46*c*. The standing wall section 46*a* is formed in the state of standing on the lower wall 42. The inclined section 46*b* is arranged on the left side of the standing wall section 46*a*. Furthermore, the inclined section 46*b* inclines to the lower wall 42, and specifically inclines to rise rightward. The inclined section 46*b* and the inclined wall 45 are horizontally symmetrically formed. The vertex section 46*c* is formed between the top end of the standing wall section 46*a* and the right top end of the inclined section 46*b*. A through-hole 46*d* is formed at the right top end of the inclined section 46*b* (the left end of the vertex section 46*c*).

The region enclosed by the standing wall section 46*a* of the projecting section 46, the right part of the lower wall 42 (the part on the right side of the standing wall section 46*a*), the right wall 44, and the right part of the upper wall 41 is the region 48. The region enclosed by the inclined section 46*b*, the left part of the lower wall 42 (the part on the left side of the inclined section 46*b*), the left wall 43, and the left part of the upper wall 41 is the region 47. The vertex section 46*c* of the projecting section 46 is separated from the upper wall 41, and the vertex section 46*c* and the upper wall 41 are opposed to each other to form a gap 49 between the vertex section 46*c* and the upper wall 41. The region 47 and the region 48 communicate with each other through the gap 49.

The backside of the shell 4 is opened, and the molded resin member 2 is inserted into the opening on the backside of the shell 4. The molded resin member 2 includes the main body section 21 and insulators 22 and 23, and the main body section 21 and insulators 22 and 23 are integrally molded with a resin. The main body section 21 is fit into the rear end side of the shell 4. The insulators 22 and 23 project forward from the front surface of the main body section 21. The insulators 22 and 23 are parallely arranged on the left and right sides in the shell 4. To put it concretely, the insulator 22 is arranged in the region 47, and the insulator 23 is arranged in the region 48. The insulators 22 and 23 are severally formed as a board, and the insulators 22 and 23 and the upper wall 41 are vertically opposed to each other.

The contacts 5 and 6 penetrate the main body section 21 longitudinally, and thereby the rears of the contacts 5 and 6 are supported by the main body section 21. The fronts of the contacts 5 are arranged along the front surface of the insulator 22. The fronts of the contacts 6 are arranged along the front surface of the insulator 23.

The elastic piece 3 is integrally formed with the shell 4. When the elastic piece 3 is in its natural state, the end of the elastic piece 3 projects to the upper part of the vertex section 46*c* of the projecting section 46 through the through-hole 46*d* of the projecting section 46. Hereby, the gap 49 between the vertex section 46*c* of the projecting section 46 and the upper wall 41 is obstructed by the end of the elastic piece 3. On the other hand, when the end of the elastic piece 3 is pushed from the upper part to the lower part, the elastic piece 3 elastically deforms, and the end of the elastic piece 3 retracts into the through-hole 46*d*. Hereby, the gap 49 is opened. When the pushing-down of the end of the elastic piece 3 is released, the elastic piece 3 is restored to its natural state, and the end of the elastic piece 3 projects to the upper part of the vertex section 46*c* of the projecting section 46.

Here, the elastic piece 3 includes a leaf spring section 31 and a partition section 32.

One end of the leaf spring section 31 is coupled to the rear end of the upper wall 41 of the shell 4. Then, the leaf spring section 31 is provided to extend from the rear end of the upper wall 41 to wrap around the lower side of the projecting section 46 through the backside of the main body section 21 of the molded resin member 2. The leaf spring section 31 wrapping around the lower side of the projecting section 46 is arranged below the vertex section 46*c* between the standing wall section 46*a* and the inclined section 46*b* of the projecting section 46.

The partition section 32 is coupled to the other end (front end) of the leaf spring section 31. To put it concretely, the partition section 32 is formed to be bent upward from the left side of the other end of the leaf spring section 31 to be in the state of standing on the leaf spring section 31.

If the leaf spring section 31 is in its natural state, the part thereof wrapping around the lower side of the projecting section 46 inclines to approach the through-hole 46*d* as the position of the part becomes nearer to the front end under the vertex section 46*c*. Namely, the part of the leaf spring section 31 wrapping around the lower side of the projecting section 46 inclines to rise higher as the part becomes nearer to the front end. If the leaf spring section 31 is in its natural state, the partition section 32 projects to the upper part of the vertex section 46*c* of the projecting section 46 through the through-hole 46*d*.

On the other hand, if the partition section 32 is pushed from the top to the bottom, the leaf spring section 31 elastically deforms, and the partition section 32 retracts into the through-hole 46*d*. Furthermore, the front upper part of the partition section 32 is formed as a surface inclining downward toward the front.

In addition, the leaf spring section 31 may be coupled to the shell 4 at a position other than the rear end of the upper wall 41. For example, the leaf spring section 31 may be coupled to the lower wall 42 at the left bottom end of the inclined section 46*b* of the projecting section 46 and extend rightward from the coupled part to the lower side of the projecting section 46. Contrarily, the leaf spring section 31 may be coupled to the lower wall 42 at the bottom end of the standing wall section 46*a* of the projecting section 46 and extend leftward from the coupled part to the lower side of the projecting section 46.

Figure 5:
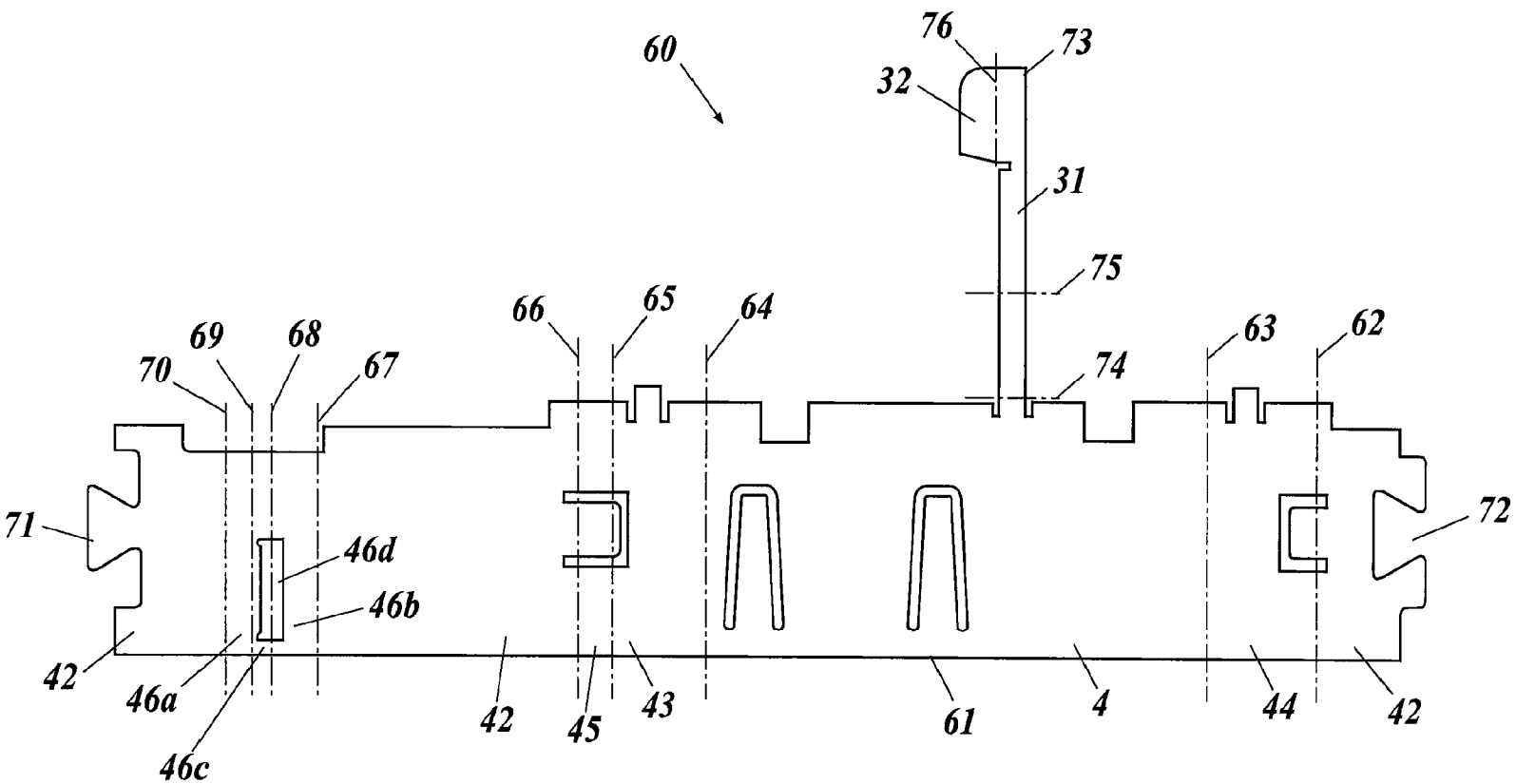
FIG. 5 is a development diagram showing the shell of the connector of the embodiment.

FIG. 5 is a development diagram showing the shell 4 and the elastic piece 3.

The shell 4 and the elastic piece 3 are formed by bending a metallic plate 60 shown in FIG. 5. The shell 4 is formed by bending the beltlike section 61 of the metallic plate 60 at bending lines 62-70 to enclose the main body section 21 of the molded resin member 2 with the beltlike section 61, and by fitting a fitting section 71 formed at one end of the beltlike section 61 to a fitting section 72 formed at the other end of the beltlike section 61. The elastic piece 3 is formed by bending a tongue flap 73, extending from the beltlike section 61, at bending lines 74-76.

As shown in FIG. 2, two types of the plug connectors 90 and 100 can be connected to the shell 4.

The shell 92 of one plug connector 90 is shaped to be fit to the whole of the shell 4, and the shell 92 can be inserted into the whole of the shell 4. An insulator 93 is provided in the shell 92, and two insertion openings 94 and 95 are formed in the insulator 93. Contacts 96 and 97 are provided in the insertion openings 94 and 95, respectively.

Figure 6:
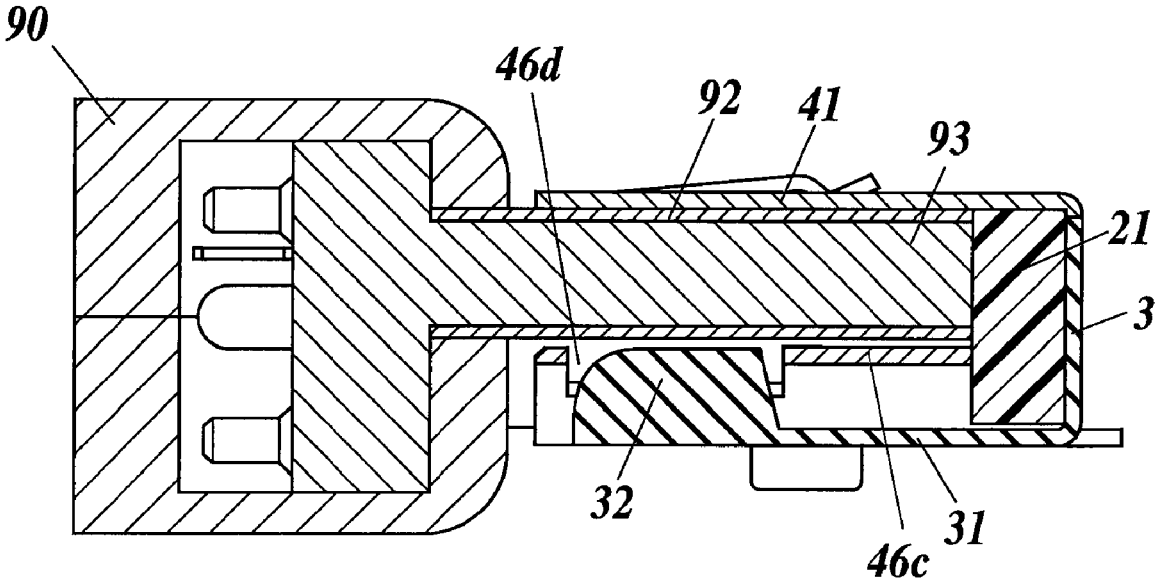
FIG. 6 is a sectional view showing the connector of the embodiment and a plug connector inserted into the connector.

As shown in the sectional view of FIG. 6, when the shell 92 and the insulator 93 are inserted into the shell 4, the partition section 32 is pushed downward by the shell 92 to retract to the lower part of the through-hole 46*d*. Because the leaf spring section 31 elastically deforms and the repulsive force of the leaf spring section 31 is exerted from the partition section 32 onto the shell 92, the shell 92 can be made to be difficult to be pulled out from the shell 4. When the shell 92 and the insulator 93 are inserted into the shell 4, the insulator 22 is fit into the insertion opening 94, and the insulator 23 is fit into the insertion opening 95. When the shell 92 is removed from the shell 4, the leaf spring section 31 is restored to its natural state, and the partition section 32 projects to the upper part of the vertex section 46*c* of the projecting section 46 through the through-hole 46*d*.

The shell 102 of the other plug connector 100 is formed in the shape of being fit to the region 47 of the shell 4, and the shell 102 can be inserted into the region 47 of the shell 4. An insulator 103 is provided in the shell 102, and an insertion opening 104 is formed in the insulator 103. The contacts 105 are provided in the insertion opening 104.

Figure 7:
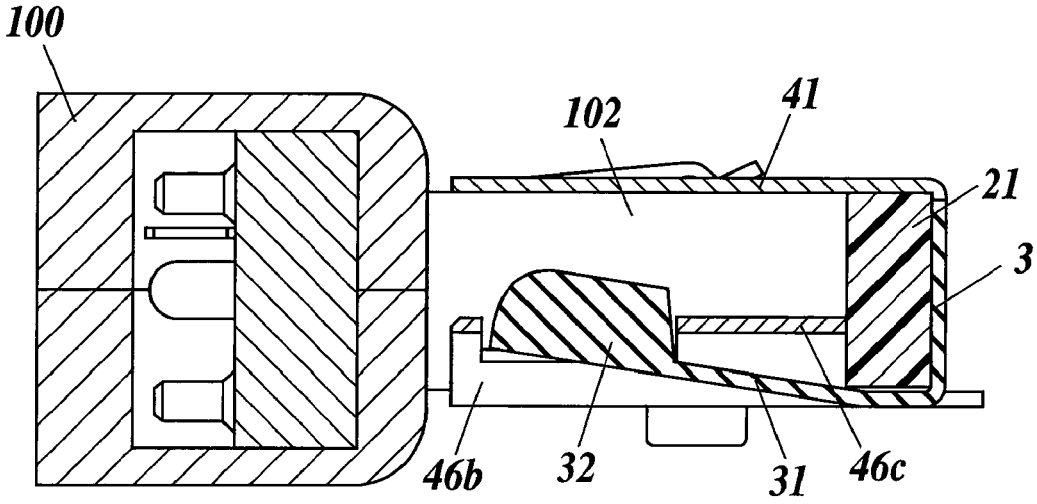
FIG. 7 is a sectional view showing the connector of the embodiment and another plug connected inserted into the connector.

As shown in the sectional view of FIG. 7, even if the shell 102 is inserted into the region 47 of the shell 4, the partition section 32 is not pushed downward, and the gap 49 is obstructed by the partition section 32. Then, a side wall of the shell 102 abuts against the partition section 32. Consequently, even if a load urging the shell 102 toward the right is exerted on the shell 102, the shell 102 is received by the partition section 32, and consequently the shell 102 can be made to be difficult to be pulled out from the region 47.

As described above, because the lower right of the region 47 of the shell 4 is formed as an inclined surface (inclined section 46*b*), the shell 102 is easily pulled out when a load urging the shell 102 of the plug connector 100, inserted in the region 47 of the shell 4, to the right, but the easiness of being pulled out can be prevented by the partition section 32.

Because the partition section 32 retracts to the lower part of the through-hole 46*d* when the shell 92 of the plug connector 90 is inserted into the shell 4, the partition section 32 is not any hindrances to inserting the shell 92.

Furthermore, the partition section 32, retracting in the through-hole 46*d*, is situated on the lower side of the projecting section 46. Namely, because the retracting partition section 32 is situated between the inclined section 46*b* and the standing wall section 46*a*, it can be prevented that the partition section 32 protrudes to the lower part than the lower wall 42.

Furthermore, because also the leaf spring section 31 is arranged between the inclined section 46*b* and the standing wall section 46*a*, the connector 1 can be made to be compact.

<Modification>

Figure 8:
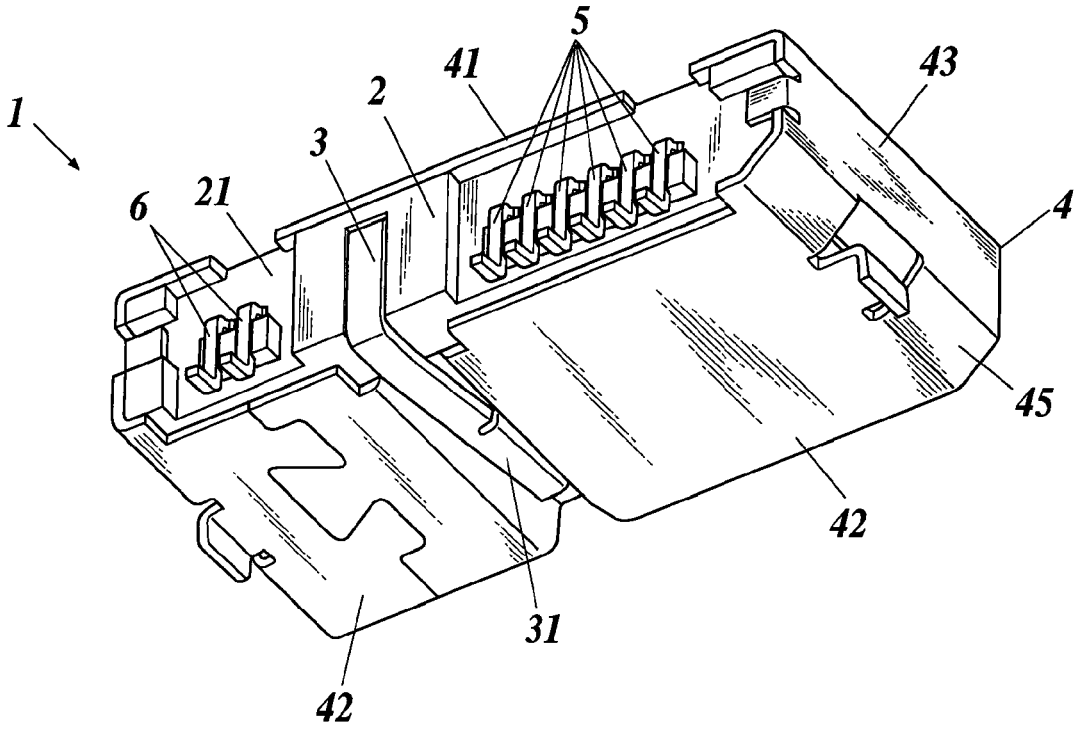
FIG. 8 is a perspective view showing the connector of a modification of the connector of the embodiment.
Figure 9:
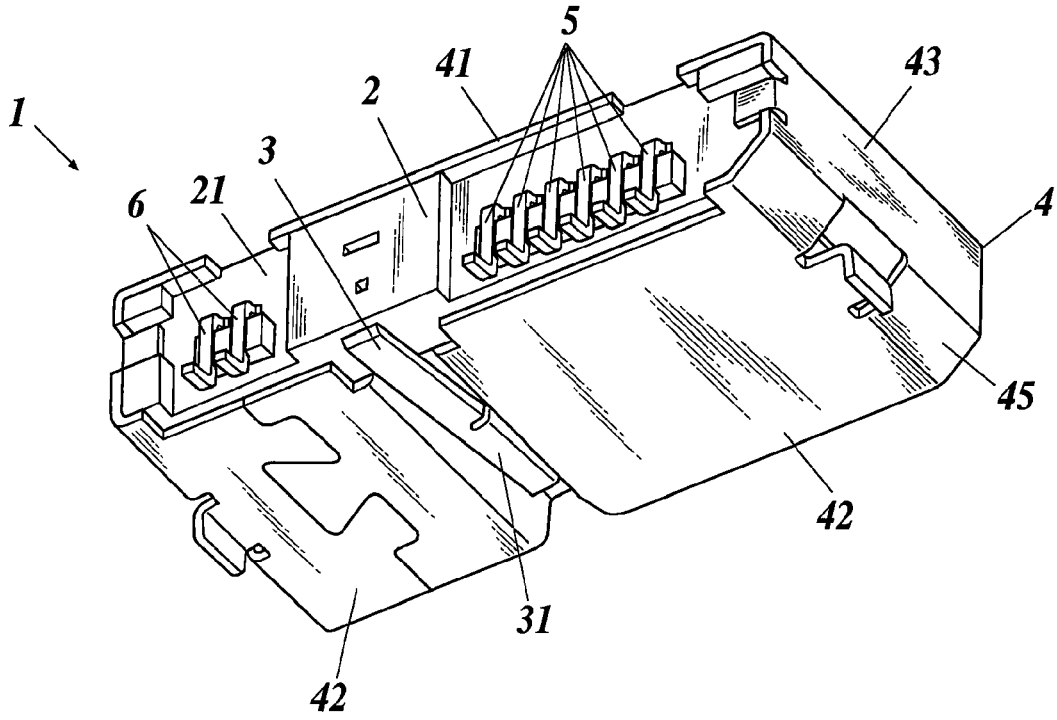
FIG. 9 is a perspective view of the connector of another modification of the embodiment.

As shown in FIGS. 8 and 9, the elastic piece 3 and the shell 4 do not have to be integrally molded. In the case of FIG. 8, one end of the leaf spring section 31 is attached onto the rear surface of the main body section 21 of the molded resin member 2, and the leaf spring section 31 is provided to wrap around the lower side of the projecting section 46. The partition section 32, provided at the other end of the leaf spring section 31, projects to the upper part of the through-hole 46*d* through the through-hole 46*d*. In the case of FIG. 9, one end of the leaf spring section 31 is attached to the under surface of the main body section 21 of the molded resin member 2, and the leaf spring section 31 extends from the attachment position to the lower side of the projecting section 46. The partition section 32, provided at the other end of the leaf spring section 31, projects to the upper part of the through-hole 46*d* through the through-hole 46*d*. In both the cases of FIGS. 8 and 9, one end of the leaf spring section 31 may be attached to the main body section 21 of the molded resin member 2 by the insert molding, or may be attached to the main body section 21 of the molded resin member 2 by assembly. Furthermore, although the elastic piece 3 is a body separated from the molded resin member 2, the elastic piece 3 may alternatively be molded integrally.

Second Embodiment

Figure 10:
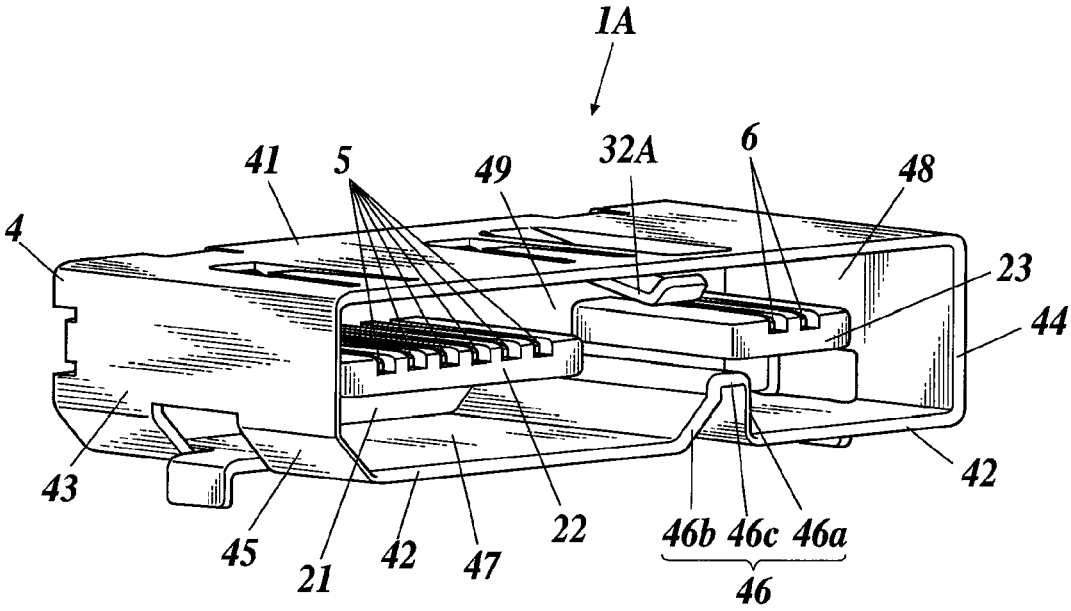
FIG. 10 is a perspective view showing the connector of a second embodiment of the present invention.

FIG. 10 is a perspective view showing the connector 1A of a second embodiment. Although the partition section 32 of the elastic piece 3 projects into the gap 49 from below in the first embodiment described above, a partition section 32A may project into the gap 49 from above in the second embodiment, as shown in FIG. 10.

The partition section 32A is provided onto the upper wall 41. To put it concretely, a U-shaped groove is formed on the upper wall 41 over the projecting section 46, and the partition section 32A is the part enclosed by the groove. The partition section 32A projects to the inside of the shell 4 by being bent. The front of the partition section 32A inclines to rise into the front direction. The partition section 32A is made to be a leaf spring.

The connector 1A of the present embodiment is configured similarly to the connector 1 of the first embodiment except for the replacement of the elastic piece 3 with the partition section 32A in comparison with the connector 1 of the first embodiment.

When the shell 92 of the plug connector 90 is inserted into the shell 4, the partition section 32A is upward pushed by the shell 92, and the shell 92 is nipped by the partition section 32A and the projecting section 46. When the shell 92 is removed from the shell 4, the partition section 32A is restored to its natural state, and projects downward from the upper wall 41.

On the other hand, even if the shell 102 of the plug connector 100 is inserted into the region 47 of the shell 4, the partition section 32A is not pushed, and holds the natural state. Consequently, because the partition section 32A is in the state of projecting into the gap 49, a side wall of the shell 102 abuts against the partition section 32A. Consequently, even if a load urging the shell 102 rightward is exerted on the shell 102, the shell 102 is received by the partition section 32A, and consequently it becomes possible to make it difficult to pull out the shell 102 from the region 47 of the shell 4.

Third Embodiment

Figure 11:
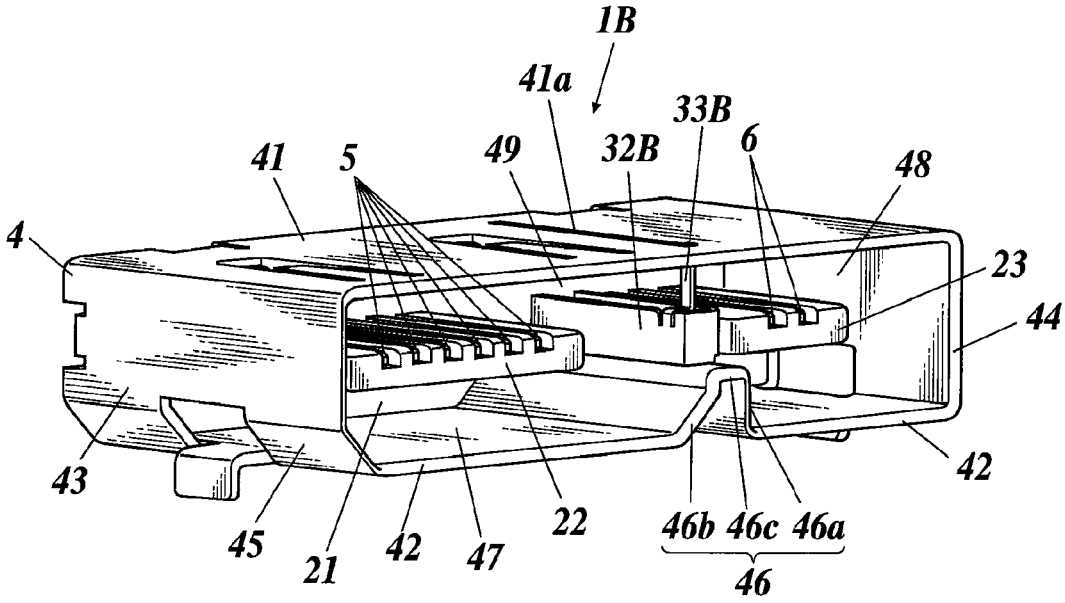
FIG. 11 is a perspective view showing the connector of a third embodiment of the present invention.
Figure 12:
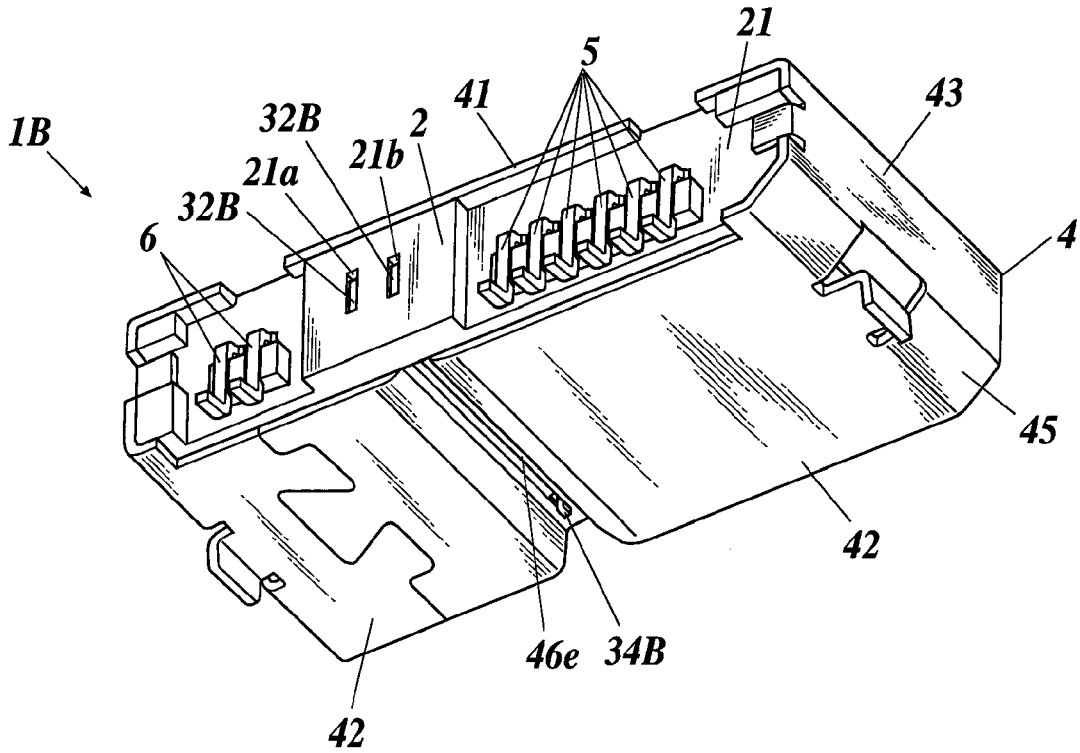
FIG. 12 is another perspective view showing the connector of the third embodiment.
Figure 13:
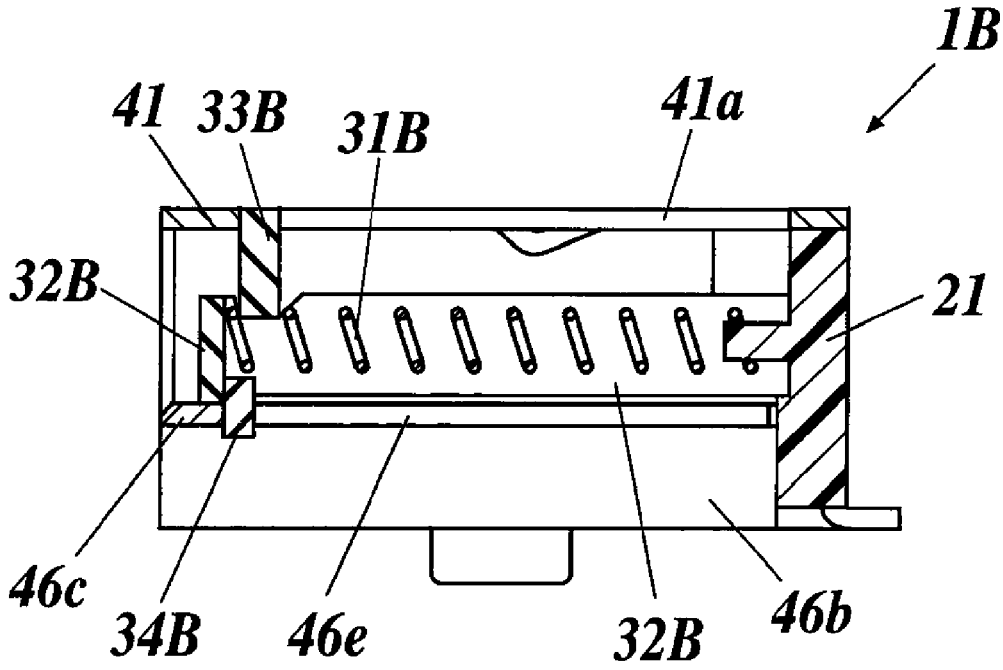
FIG. 13 is a sectional view showing the connector of the third embodiment.

FIGS. 11 and 12 are perspective views showing the connector 1B of a third embodiment. FIG. 13 is a longitudinal sectional view.

The connector 1B of the present embodiment includes a spring 31B and a partition section 32B in place of the elastic piece 3 of the connector 1 of the first embodiment. The partition section 323 includes side wall sections on both sides and a front wall section, and is formed in a U letter as viewed from above. The partition section 32B is a slider provided to be longitudinally slidable over the vertex section 46*c* of the projecting section 46. To put it concretely, the partition section 32B is longitudinally guided along slits 41*a* and 46*e* as the guiding sections long in the front-rear direction. The slit 46*e* is formed in the vertex section 46*c* of the projecting section 46, and the slit 41*a* is formed in the upper wall 41 at a position opposed to that of the slit 46*e*. Pins 33B and 34B are provided above and below the front of the partition section 32B, respectively, and the pins 33B and 34B are inserted into the slits 41*a* and 46*e*, respectively. Furthermore, through-holes 21*a* and 21*b* are formed in the main body section 21 of the molded resin member 2 above the projecting section 46, and the through-holes 21*a* and 21*b* penetrate the main body section 21 from the front surface thereof to the rear surface thereof. The side wall sections of the partition section 32B on both the sides thereof are inserted into the through-holes 21*a* and 21*b*, respectively.

The spring 31B is arranged in the partition section 32B. One end of the spring 31B is coupled to the front end of the partition section 32B, and the other end of the spring 31B is coupled to the front surface of the main body section 21. In the state in which the spring 31B is not compressed, the pins 33B and 34B are situated at the front ends of the slits 41*a* and 46*e*, respectively. Hereby, the gap 49 is obstructed by the partition section 32B.

The connector 1B of the present embodiment is configured similarly to the connector 1 of the first embodiment except for the replacement of the elastic piece 3 with the spring 31B and the partition section 32B in comparison with the connector 1 of the first embodiment.

Figure 14:
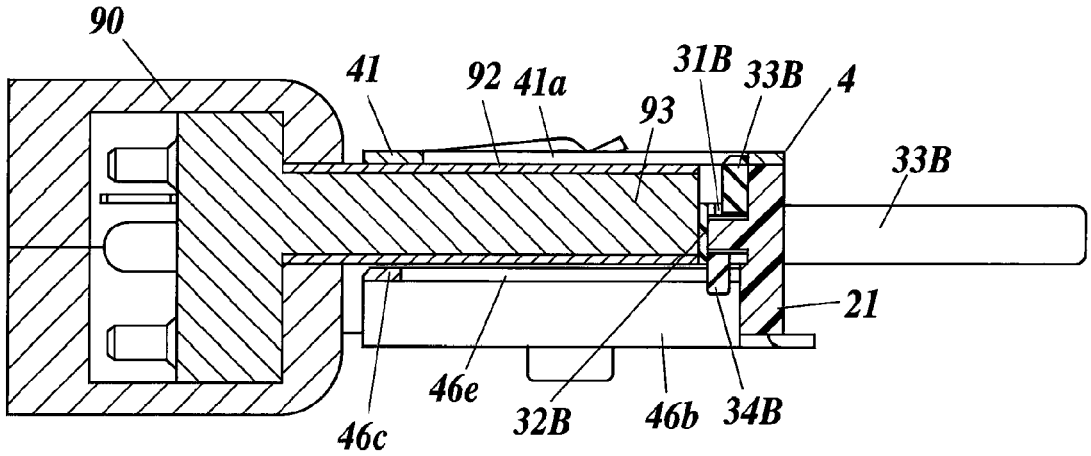
FIG. 14 is a sectional view showing the connector of the third embodiment and a plug connector inserted into the connector.

As shown in FIG. 14, when the shell 92 of the plug connector 90 is inserted into the shell 4, the partition section 32B is pushed backward by the shell 92, and the spring 31B is compressed. When the shell 92 is removed from the shell 4, the spring 31B is restored, and the partition section 32B slides forward to project forward.

Figure 15:
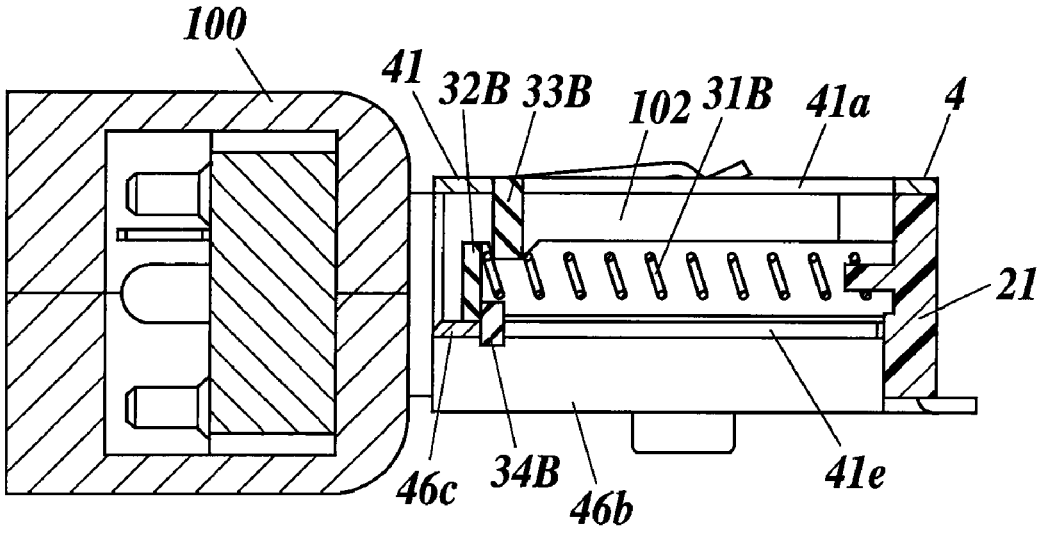
FIG. 15 is a sectional view showing the connector of the third embodiment and another plug connector inserted into the connector.

On the other hand, as shown in FIG. 15, even if the shell 102 of the plug connector 100 is inserted into the region 47 of the shell 4, the partition section 32B is not pushed to be held in the state of projecting forward. Consequently, the gap 49 is left in the state of being obstructed by the partition section 32B, and a side wall of the shell 102 abuts against the partition section 32B. Consequently, even if a load urging the shell 102 rightward is exerted onto the shell 102, the shell 102 is received by the partition section 32B, and consequently the shell 102 can be made to be difficult to be pulled out from the region 47 of the shell 4.

According to an aspect of the preferred embodiments of the present invention, there is provided a connector, comprising:

a shell provided as a cylindrical shape having an opened front side;

a first insulator arranged in the shell;

a second insulator arranged in the shell to be parallel to the first insulator;

a first contact provided to be arranged in the first insulator;

a second contact provided to be arranged in the second insulator; and a partition section arranged in the shell in a state of projecting from an outside of the shell to an inside of the shell so as to partition a hollow in the shell to a first region in which the first insulator exists and a second region in which the second insulator exists as viewed from the front side of the shell, the partition section being provided to be movable to the outside of the shell.

According to the present invention, when a plug connector having a size to be fit into the whole of the first and second regions in the shell is inserted into the shell, the partition section is pushed by the plug connector to move to the outside of the shell, and the first insulator and the second insulator are inserted into the plug connector.

On the other hand, when the plug connector having a size to be fit into the first region in the shell is inserted into the first region in the shell, the partition section is not pushed by the plug connector to be left in the arranged state in the shell, and the first insulator is inserted into the plug connector. Because the plug connector is received by the partition section even if the plug connector is pushed to the second region side in that state, it is possible to make it difficult to pull out the plug connector. The case where the plug connector having a size to be fit into the second region in the shell is inserted into the second region in the shell is similar to the above case.

Preferably, the connector further comprises a spring section to hold the partition section so that the partition section projects from the outside of the shell to the inside of the shell, wherein the spring section elastically deforms when the partition section moves to the outside of the shell.

According to the above configuration, when a plug connector having a size to be fit into the whole of the first and second regions in the shell is inserted into the shell, the partition section is pushed by the plug connector, and the spring section elastically deforms. When the plug connector is pulled out, the spring section returns to its original shape, and the partition section projects into the shell.

Furthermore, even if a plug connector having a size to be fit into the first or second region in the shell is inserted into the first or second region, the partition section is not pushed by the plug connector and is held by the spring section to be left in the state of being arranged in the shell. Consequently, the plug connector can be made to be difficult to be pulled out.

Preferably, the connector further comprises:

a projecting section provided to project to the inside of the shell between the first region and the second region; and a through-hole penetrating the projecting section from the inside of the shell to the outside of the shell, wherein the spring section is arranged in the outside of the shell on an opposite side of the projecting section; and the partition section is provided to the spring section to project into the shell through the through-hole.

According to the above configuration, because the spring section is arranged on the outside of the shell on the opposite side of the projecting section, the structure of the connector can be made to be simple.

Furthermore, when a plug connector having a size to be fit into the first or second region in the shell is inserted into the first or second region, the plug connector is nipped by the partition section and the inner wall of the shell opposed to the projecting section by the elastic force of the spring section, and consequently the pulling-out of the plug connector can be prevented.

Preferably, the spring section is a leaf spring section longitudinally extending to the outside of the shell on the opposite side of the projecting section;

the spring section inclines in a direction of approaching the through-hole toward a front of the connector; and the partition section is provided at the front of the spring section.

According to the above configuration, because the spring section is the leaf spring section, the structure of the connector can be made to be simple.

Preferably, the partition section is provided to be longitudinally movable between the first region and the second region; and the spring section holds the partition section from a rear of the partition section.

Preferably, the connector further comprises a projecting section provided to project to the inside of the shell between the first region and the second region, wherein the partition section is provided to be longitudinally movable on the projecting section.

According to the above configurations, when a plug connector having a size to be fit into the whole of the first and second regions in the shell is inserted into the shell, the partition section is pushed backward by the plug connector, and the spring section elastically deforms. When the plug connector is pulled out, the spring section returns to its original shape, and the partition section moves forward to project into the shell.

Furthermore, even if a plug connector having a size to be fit into the first or second region in the shell is inserted into the first or second region, the partition section is not pushed by the plug connector and is held by the spring section to be left in the state of being arranged in the shell. Consequently, the plug connector can be made to be difficult to be pulled out.

Preferably, the connector further comprises a projecting section provided to project to the inside of the shell between the first region and the second region, wherein the partition section is a leaf spring provided at a position inside of the shell to be opposed to the projecting section, the leaf spring elastically deforming to the outside of the shell.

According to the above configuration, when a plug connector having a size to be fit into the whole of the first and second regions in the shell is inserted into the shell, the partition section is pushed by the plug connector, and the spring section elastically deforms. Because the plug connector is nipped between the partition section and the projecting section by the elastic force of the partition section, the pulling-out of the plug connector can be prevented.

On the other hand, even if a plug connector having a size to be fit into the first or second region in the shell is inserted to the first or second region, the partition section is left to be arranged in the shell. Consequently, the plug connector can be made to be difficult to be pulled out.

Preferably, a part of the projecting section in the first region side is inclined.

According to the above configuration, if a plug connector having a size to be fit into the first region in the shell is inserted into the first region, the plug connector is easily pulled out when the plug connector is pushed to the second region side because the part of the projecting section on the first region side is inclined. Such pulling-out can, however, be prevented by the partition section.

According to the present invention, even if a plug connector having a size to be fit into the first or second region in the shell is inserted into the first or second region, the pulling-out of the plug connector can be prevented.

The entire disclosure of Japanese Patent Application No. 2009-160319 filed on Jul. 7, 2009 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A connector, comprising:

a shell provided as a cylindrical shape having an opened front side;

a first insulator arranged in the shell;

a second insulator arranged in the shell to be parallel to the first insulator;

a first contact provided to be arranged in the first insulator;

a second contact provided to be arranged in the second insulator; and a partition section integrally formed with the shell in a state of projecting from an outside of the shell to an inside of the shell so as to partition a hollow in the shell to a first region in which the first insulator exists and a second region in which the second insulator exists as viewed from the front side of the shell, the partition section being provided to be movable to the outside of the shell.

2. The connector as claimed in claim 1, further comprising a spring section to hold the partition section so that the partition section projects from the outside of the shell to the inside of the shell, wherein the spring section elastically deforms when the partition section moves to the outside of the shell.

3. The connector as claimed in claim 2, further comprising:

a projecting section provided to project to the inside of the shell between the first region and the second region; and a through-hole penetrating the projecting section from the inside of the shell to the outside of the shell, wherein the spring section is arranged in the outside of the shell on an opposite side of the projecting section; and the partition section is provided to the spring section to project into the shell through the through-hole.

4. The connector as claimed in claim 3, wherein the spring section is a leaf spring section longitudinally extending to the outside of the shell on the opposite side of the projecting section;

the spring section inclines in a direction of approaching the through-hole toward a front of the connector; and the partition section is provided at the front of the spring section.

5. The connector as claimed in claim 2, wherein the partition section is provided to be longitudinally movable between the first region and the second region; and the spring section holds the partition section from a rear of the partition section.

6. The connector as claimed in claim 5, further comprising a projecting section provided to project to the inside of the shell between the first region and the second region, wherein the partition section is provided to be longitudinally movable on the projecting section.

7. The connector as claimed in claim 1, further comprising a projecting section provided to project to the inside of the shell between the first region and the second region, wherein the partition section is a leaf spring provided at a position inside of the shell to be opposed to the projecting section, the leaf spring elastically deforming to the outside of the shell.

8. The connector as claimed in claim 3, wherein a part of the projecting section in the first region side is inclined.

9. The connector as claimed in claim 4, wherein a part of the projecting section in the first region side is inclined.

10. The connector as claimed in claim 6, wherein a part of the projecting section in the first region side is inclined.

11. The connector as claimed in claim 7, wherein a part of the projecting section in the first region side is inclined.

* * * * *